United States Patent [19]

Chung-Tai

[11] Patent Number: 5,028,763

[45] Date of Patent: Jul. 2, 1991

[54] HIGH HEAT DISSIPATION PTC HEATER STRUCTURE

[76] Inventor: Chang Chung-Tai, No. 10, Lane 154, Chung Hwa Road, Yung Kang Hsiang, Tainan Hsien, Taiwan

[21] Appl. No.: 378,949

[22] Filed: Jul. 11, 1989

[51] Int. Cl.[5] ..... H05B 1/02; H05B 3/06; F24H 3/04; H01C 7/02

[52] U.S. Cl. ..... 219/530; 219/505; 219/540; 219/541; 338/22 R; 338/53; 392/347; 392/379

[58] Field of Search ..... 319/375, 381, 382, 307, 319/205-207, 365, 541, 540, 530, 504, 505; 338/22 R, 53; 123/549, 557; 392/347, 379

[56] References Cited

U.S. PATENT DOCUMENTS

| | | | |
|---|---|---|---|
| 4,123,851 | 11/1978 | Itoh et al. | 219/204 X |
| 4,346,285 | 8/1982 | Makamura et al. | 219/382 X |
| 4,703,153 | 10/1987 | Pelonis | 219/541 X |
| 4,876,436 | 10/1989 | Ide et al. | 219/382 X |
| 4,899,032 | 2/1990 | Schwarzl et al. | 219/375 |

FOREIGN PATENT DOCUMENTS

| | | | |
|---|---|---|---|
| 194507 | 9/1986 | European Pat. Off. | 219/375 |
| 52-33160 | 3/1977 | Japan | 219/376 |
| 54-40344 | 3/1979 | Japan | 219/375 |

*Primary Examiner*—Anthony Bartis
*Attorney, Agent, or Firm*—Varndell Legal Group

[57] ABSTRACT

A pair of plates of good heat and electric conductivity have a plurality of openings and a plurality of foraminous areas. The plates are secured to one another with the openings and foraminous areas of the two plates aligned with one another. The plates are connected to terminals of opposite electrical polarity and are insulated from one another. A plurality of perforated PTC thermistor elements are clamped between the plates and in electrical contact therewith. Each element is aligned with openings in the plates. The openings and foraminous areas are so disposed that the openings associated with the elements are surrounded on at least two sides by foraminous areas.

2 Claims, 2 Drawing Sheets

HIGH HEAT DISSIPATION PTC HEATER STRUCTURE

BACKGROUND OF THE INVENTION

This invention aims to improve the structure of a PTC heater in such a way that the thermal energy given out of every PTC thermistor element can be utilized as efficiently as possible.

The better the heat dissipating coefficient of a PTC heater is, the higher its effectiveness is. One method of increasing the heat dissipating coefficient is to provide a PTC heater having a large area to conduct the heat produced by the PTC thermistor elements and to radiate it away from the PTC thermistor as much as possible.

SUMMARY OF THE INVENTION

The structure for a PTC heater according to the present invention includes a pair of spaced square frames fixed and locked together in face-to-face relationship. The plates are made of good electrical and thermal conductivity material. The plates are provided with square openings and square foraminous areas arranged alternately in vertical and horizontal rows such that each square opening is surrounded on at least two sides by adjacent foraminous areas. The foraminous areas and openings of one plate are disposed in alignment respectively with the foraminous areas and openings of the other plate. A plurality of square perforated PTC thermistor elements are sandwiched between and in electrical contact with the plates with each thermistor element positioned in each pair of aligned openings in the plates.

Each of the frames is insulated from the other so that they can be connected to terminals of opposite electrical polarity. When the frames are so connected, current flows through the thermistor elements to generate heat.

The heat generated from each PTC thermistor element can be conducted through the body of the frames to the foraminous areas from which the heat can be radiated away quickly. In other words, a PTC heater fabricated according to this structure has a higher heat dissipating coefficient than conventional PTC heaters.

DETAILED DESCRIPTION OF THE INVENTION

Figure 1:
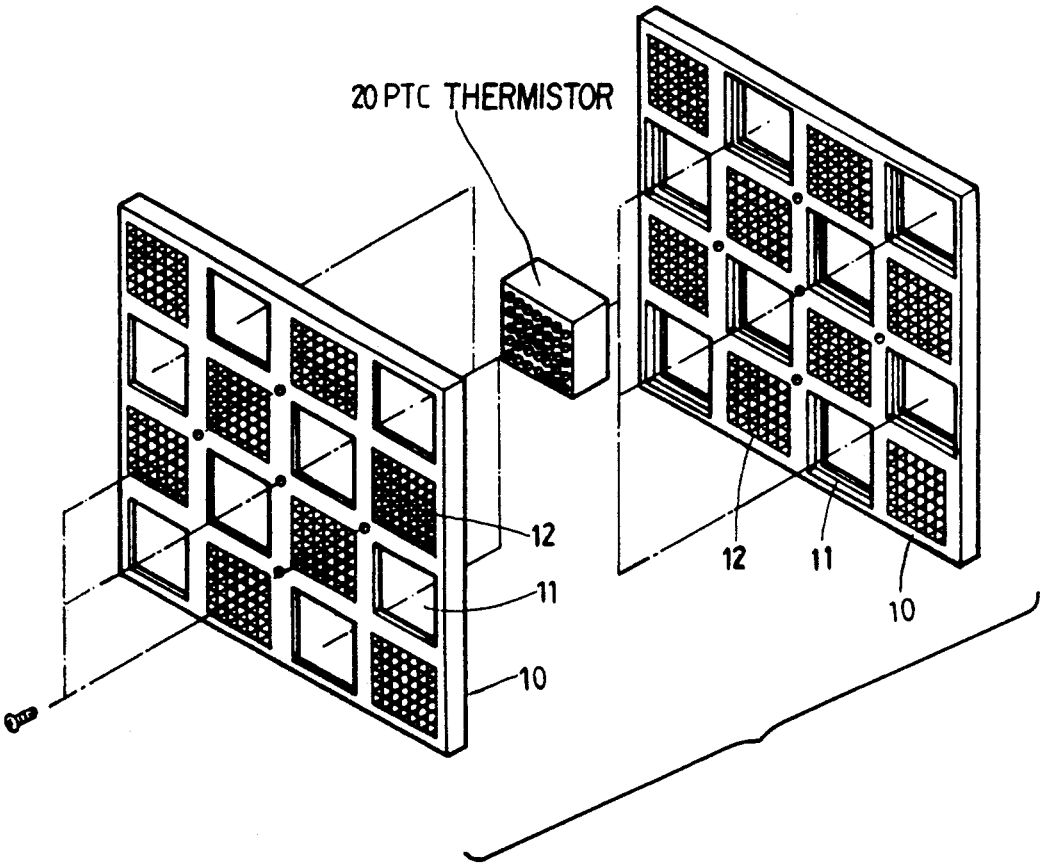
FIG. 1 is a perspective view of an exploded PTC heater in accordance with the present invention.
Figure 2:
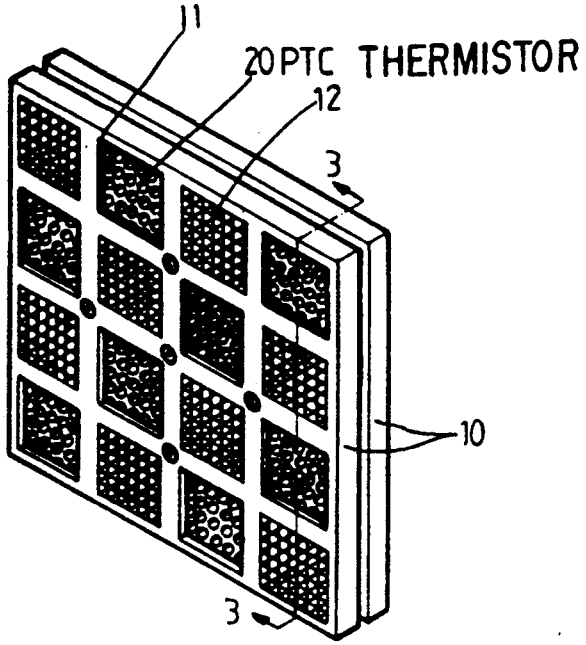
FIG. 2 is a perspective view of a PTC heater fabricated in accordance with the present invention.
Figure 3:
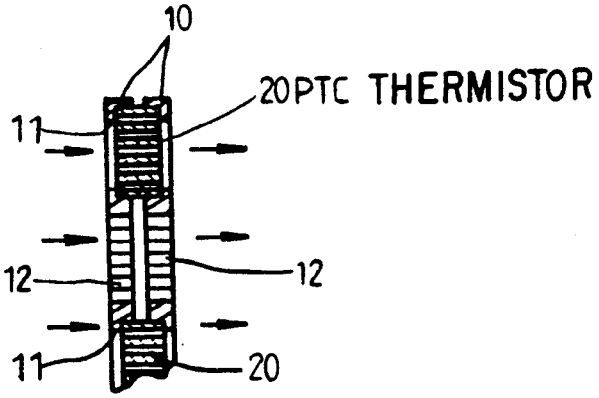
FIG. 3 is a cross-sectional view of a fragmental PTC heater in accordance with the present invention taken along lines 3—3 of FIG. 2.

First, as shown in FIGS. 1, 2 and 3, the structure for a PTC heater in accordance with the present invention contains two square spaced stacked heat radiating plates 10 made of a material of good electric and heat conductivity. Each plate is provided with a plurality of square openings 11 whose edges are L-shaped in cross-section and a plurality of square foraminous areas 12. Each opening 11 and each foraminous area 12 are regularly located next to each other either in the horizontal or the vertical direction such that the pair of plates 10 are fixed and locked together in face-to-face relation, and each plate 10 is connected with a terminal of different polarity, i.e. one with positive polarity and one with negative polarity. The two plates are electrically insulated from each other.

A perforated positive-temperature-coefficient (PTC) thermistor element 20 with many small holes is known and it is not necessary to describe it here. As seen in FIGS. 2 and 3, in each pair of the openings 11 is clamped a PTC thermistor element 20; and after the two frames 10 have been locked together, the PTC thermistor element 20 in each pair of openings 11 is clamped in position.

In fabricating this heater, each PTC thermistor element 20 is placed in each opening 11 of a frame 10, and then another frame 10 is fixed and locked in face-to-face relation to the first frame 10 thereby clamping each of the PTC thermistor elements in a pair of the openings. The two frames 10 are insulated from each other before they are fixed and locked together, as each frame 10 has a different electrical polarity.

When this heater is assembled and electricity is conducted through it, each PTC thermistor element 20 gives out heat, which is conducted from each opening 11 through the body of the frame 10 to adjacent foraminous areas 12 so that the heat given out by each PTC thermistor element 20 can be conducted away. When air blows through this PTC heater, every PTC thermistor element 20 and every foraminous area dissipates heat to the air so that this PTC heater has a better heat effectiveness than the traditional ones.

After the PTC heater begins to receive electrical energy, the thermistor elements 20 will consume electric energy, and the input $V \times I$ where $V$=voltage and $I$=current is accompanied by the rise in temperature and dissipation of the heat from the thermistor elements.

The following is an equation in relation to the thermoelectric power P.

$$PdT = VIdt = HdT + D(T - Ta)dt$$

P=thermoelectric power
V=voltage I=current
H=heat volume D=heat dissipating coefficient
T=a surface temperature of the thermistor
Ta=an ambient temperature It is known from the equation that the higher the heat dissipating coefficient is, the more the volume of heat given out is. The structure of this PTC heater raises the heat dissipating coefficient higher than a conventional PTC heater having the same number of PTC thermistor elements of the same size.

The characteristic of the known PTC thermistor element for generating heat is that when the rising temperature thereof reaches the Curie point, the Ohmic resistance of the PTC thermistor element sharply increases converting itself into an electric insulator and preventing the passage of the electric current and thus renders the temperature thereof to drop. The Ohmic resistance of the thermistor sharply decreases recovering its conductivity so that it can once again permit the electric current to pass therethrough and to generate heat, as the temperature drops below the Curie point. Therefore, the electric current passing through the PTC thermistor element can change at the beginning of the passage of current and then keep a balanced stable value.

The reaction time of a heater to reach the Curie point, i.e. the balanced stable current, has a relation to the heat volume and the heat dissipating coefficient of the PTC heater itself, the voltage it receives and the resistance of the PTC thermistor elements. The smaller the heat volume and the resistance and the larger the voltage and the heat dissipating coefficient, the shorter the reaction time. As this PTC heater has a large heat dissipating coefficient, it can react in a very short time.

The PTC thermistor elements 20 can be arranged so that they are disposed adjacent one another instead of being separated by foraminous areas. When thermistor elements 20 are so disposed in adjacent relationship, the foraminous areas are then located in surrounding relationship to the thermistor elements which are adjacent one another.

I claim:

1. A PTC heater comprising a pair of square heat radiating plates each provided with a plurality of square openings and square foraminous areas regularly arranged such that each opening is surrounded on at least two sides by adjacent foraminous areas, a plurality of square perforated PTC thermistor elements corresponding in number to the number of said openings, said square plates being made of good heat and electric conductivity material and being insulated from one another, said plates being disposed in face-to-face relationship with one another, means securing said plates in position with said thermistor elements clamped between said plates with said elements being in electrical contact with the plates, the openings and the foraminous areas of the two plates being in alignment with each other, the openings and foraminous areas being located alternately in vertical and horizontal rows, said PTC thermistor elements being disposed between said plates with each element being aligned with respective ones of the openings so that air flow through the openings can flow through the perforated PTC thermistor elements, such that heat is conducted from said thermistor elements directly to air flowing therethrough and also is conducted to each of said foraminous areas for further conducting heat to air flowing through said foraminous areas thereby effectively radiating heat from said PTC thermistor elements to surrounding air.

2. A PTC heater comprising a pair of heat radiating plates, each provided with a plurality of openings and a plurality of foraminous areas, said plates being made of good heat and electric conductivity material and being insulated from each other, means for securing such plates in face to face relationship with said openings and said foraminous areas of the two plates being in alignment with each other, a plurality of perforated PTC thermistor elements, each element being in alignment with one of said openings and being clamped between said plates such that air can flow through said perforated PTC thermistor elements and said foraminous areas, said elements being in electrical contact with said plates, said openings and foraminous areas being disposed such that openings associated with said elements are surrounded on at least two sides by foraminous areas such that heat is conducted from said thermistor elements directly to air flowing therethrough and also is conducted to each of said foraminous areas for further conducting heat to air flowing through said foraminous areas so as to effectively radiate heat from said PTC thermistor elements to surrounding air.

* * * * *